United States Patent [19]

Silengo et al.

[11] Patent Number: 4,828,105

[45] Date of Patent: May 9, 1989

[54] CASSETTE HOLDING CARD

[76] Inventors: Stanley J. Silengo, 324 N. 15th St., Canon City, Colo. 81212; Shawn T. Cruzen, 228 W. 2nd St., Florence, Colo. 81226

[21] Appl. No.: 153,948

[22] Filed: Feb. 9, 1988

[51] Int. Cl.[4] ..... B65D 85/672

[52] U.S. Cl. ..... 206/232; 206/387; 229/68 R

[58] Field of Search ..... 40/159; 206/232, 387, 206/459, 472, 477, 486; 229/68 R, 72

[56] References Cited

U.S. PATENT DOCUMENTS

| | | | |
|---|---|---|---|
| 3,174,244 | 3/1965 | Walton . | |
| 3,430,761 | 3/1969 | Pelkey . | |
| 3,595,383 | 7/1971 | Boylan . | |
| 3,829,132 | 8/1974 | Willieme | 206/387 |
| 3,990,574 | 11/1976 | Roccaforte | 206/387 |
| 4,004,689 | 1/1977 | Glasell . | |
| 4,054,242 | 10/1977 | Strobe . | |
| 4,129,214 | 12/1978 | Gendron . | |
| 4,134,495 | 1/1979 | Friedman . | |
| 4,290,524 | 9/1981 | Azar | 206/232 |
| 4,307,806 | 12/1981 | Haubert . | |
| 4,322,000 | 3/1982 | Struble | 206/387 |
| 4,433,780 | 2/1984 | Ellis . | |
| 4,438,846 | 3/1984 | Stylianou | 206/387 |
| 4,473,153 | 9/1984 | Colangelo . | |
| 4,621,729 | 11/1986 | Jackson | 206/232 |
| 4,640,413 | 2/1987 | Kaplan et al. . | |
| 4,653,639 | 3/1987 | Traynor | 229/72 |

*Primary Examiner*—Jimmy G. Foster

*Attorney, Agent, or Firm*—Nixon & Vanderhye

[57] ABSTRACT

A greeting card or similar device incorporating a standard audio cassette, and related process is disclosed. The card comprise a single sheet of cover stock formed into three adjacent panels of substantially identical width separated by vertical fold lines. A first end panel is also provided with upper and lower tabs or flaps, a side tab or flap, and a substantially rectangular aperture. The upper and lower tabs are folded inwardly and the first panel then folded to overlie the second panel. The upper and lower tabs are adhesively secured to the second panel to form a cassette receiving pocket therebetween. The audio cassette is adhesively but removably mounted to a separate carrier sheet and slidably received within the pocket. The third panel, forming the cover sheet of the card, is then folded over the combined first and second inside panels of the card. The card as well as the cassette carrier are preferably formed of three ply cardboard cover stock.

20 Claims, 2 Drawing Sheets

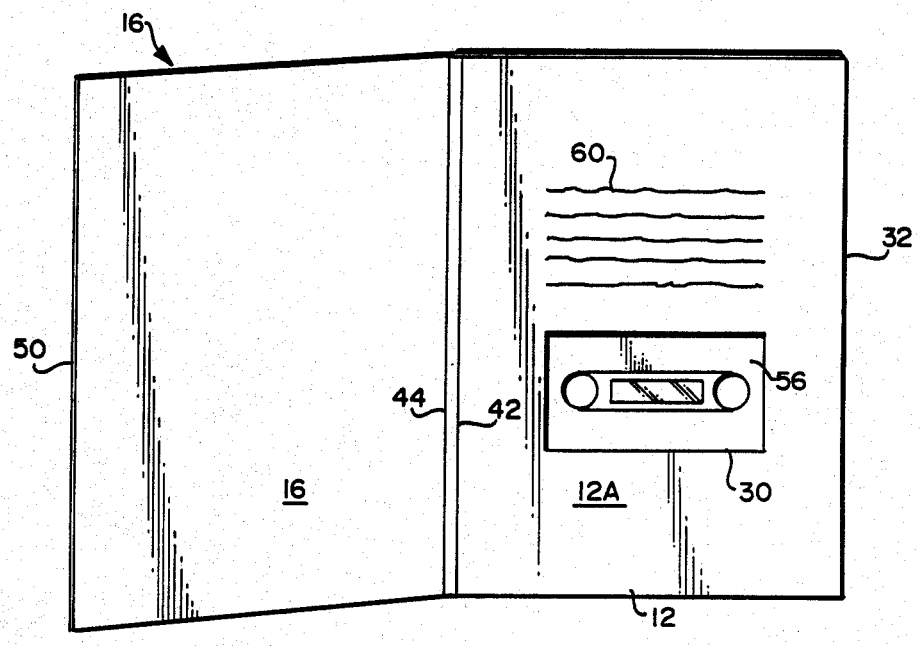
FIG. 3
FIG. 4
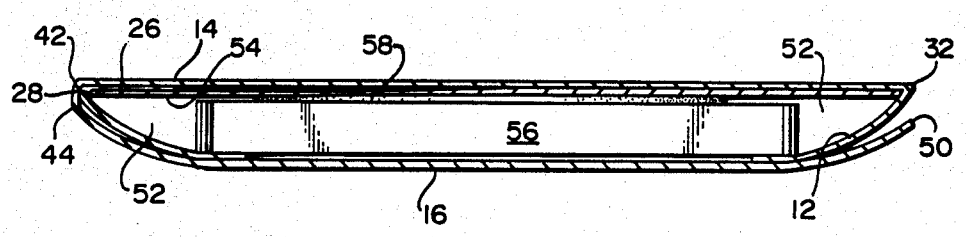

CASSETTE HOLDING CARD

BACKGROUND AND SUMMARY OF THE INVENTION

The present invention relates generally to enclosures used for sending, by mail for example, audio cassettes or articles of similar size and shape.

More specifically, the invention relates to a novel greeting card structure which incorporates a standard audio tape cassette, but which will nevertheless fit within a standard, flat envelope, and to a process for forming such a card.

It is known in the prior art to incorporate an audio tape cassette within a greeting card. See, for example, U.S. Pat. No. 4,433,780. In this patent, a foldable member is provided with a receptacle for carrying the cassette. The receptacle is adhesively secured to the foldable member and the latter is then folded into a rectilinear box which itself forms a package to be mailed.

It is also known to package and/or display audio cassettes in various carriers or cartons, examples of which may be found in U.S. Pat. Nos. 4,307,806; 4,134,495; 4,004,689; and 3,595,383.

A problem with the prior art-type constructions is the relatively bulky structure which precludes insertion of the greeting card in a standard, flat envelope. In addition, the prior art-type cards and/or display packages oftentimes have a relatively complex, and therefore more costly, construction.

It is an object of the present invention to provide a greeting card which incorporates a standard audio cassette, wherein the card construction is simple and inexpensive to manufacture, yet very effective in the manner in which it incorporates the audio cassette into the card so as to prevent separation of the cassette from the card, accidentally or otherwise, prior to purchase and/or mailing. The greeting card structure of this invention is also characterized by an uncluttered, streamlined appearance. In this regard, the overall card configuration is substantially flattened so that it may be inserted easily within standard, flat envelopes which correspond to the card size.

In an exemplary embodiment, the greeting card is constructed substantially from a single, elongated blank of thin cardboard known as cover stock (preferably 3-ply), folded along laterally spaced, vertical fold lines to form three panels of substantially equal width. A first of the panels is also cut initially to include upper and lower tabs or flaps foldable about horizontal fold lines which are laterally aligned with the upper and lower edges, respectively, of the other two panels. The tabs are foldable inwardly to partially overlie the associated panel.

This first panel is also provided with a side tab or flap along one end of the panel, remote from the second and third panels, and is also foldable inwardly to overlie a portion of the panel as will be explained more fully hereinbelow.

To form the card, the upper and lower tabs of the first panel are folded inwardly to overlie the first panel. The first panel is then folded to overlie the second panel and the upper and lower tabs are adhesively secured to the second panel, thereby forming a pocket having an opening extending generally between and along the side tab of the first panel and a pair of vertical fold lines separating the second and third panels.

A separate audio cassette carrier sheet, preferably also made from cover stock, is provided and sized to fit fairly snugly within the pocket between the first and second panels. The audio cassette itself is separably attached to the card by any suitable means, such as a strip of double-sided adhesive tape.

The carrier sheet and attached cassette are slidably inserted within the pocket and, thereafter, the side tab provided on the first panel is folded into the pocket, behind the carrier sheet, to securely enclose the cassete and carrier sheet within the pocket.

A third panel may then be folded into overlying relationship with the first and second panels.

As previously mentioned, the second and third panels are separated by a vertically oriented double fold line, comprising a pair of fold lines laterally spaced by about 0.25 inches. This arrangement tends to compensate for the thickness of the cassette, and permits the third or cover panel to lie substantially flat on the combined first and second panels. In this arrangement, the lateral distance between the two adjacent fold lines becomes an edge surface, at least partially defining the thickness of the card.

The combination of single fold line separating the first and second panels, and a double fold line separating the second and third panels, results in an overall relatively thin and flat configuration which is easily received in a standard flat envelope, for example, of the 6 inch by 9 inch size.

It is also a feature of this invention to provide a substantially rectangular aperture in the first panel, so as to permit observation of at least a part of the audio cassette when the card is opened. The aperture is not so large, however, as to permit passage of the cassette therethrough. This is a significant feature in that, taken with the other structural aspects of the greeting card, such as the side tab construction, the cassette is firmly secured within the card, reducing substantially any chance of separation of the cassette by accident, theft, or the like, prior to sale and/or mailing.

In a related aspect, this invention relates to a process for enclosing an audio cassette within a greeting card structure. The process is comprised, broadly, of the following steps:

(a) providing an elongted sheet of foldable material;

(b) folding the sheet to form three panels of substantially identical width;

(c) providing upper and lower tabs or flaps on a first of the three panels;

(d) folding the upper and lower tabs inwardly to overlie the first panel;

(e) adhesively securing the upper and lower tabs to a second of the panels to thereby form a pocket;

(f) releasably attaching an audio cassette to a carrier sheet;

(g) inserting the audio cassette and carrier sheet into the pocket; and (h) folding a third of the three panels into overlying relationship with the first and second panels.

As will be appreciated, the above described structure and process involves simple construction and assembly steps which are relatively inexpensive, and which provide advantages and benefits heretofore unavailable in the prior art.

Other objects and advantages of the subject invention will become apparent from the detailed description which follows.

BRIEF DESCRIPTION OF THE DRAWINGS

FIG. 3 is a perspective view of a greeting card in accordance with the invention, opened and with an audio cassette inserted therein; and FIG. 4 is a sectional view of a completed and closed greeting card in accordance with the invention.

DETAILED DESCRIPTION OF THE DRAWINGS

Figure 1:
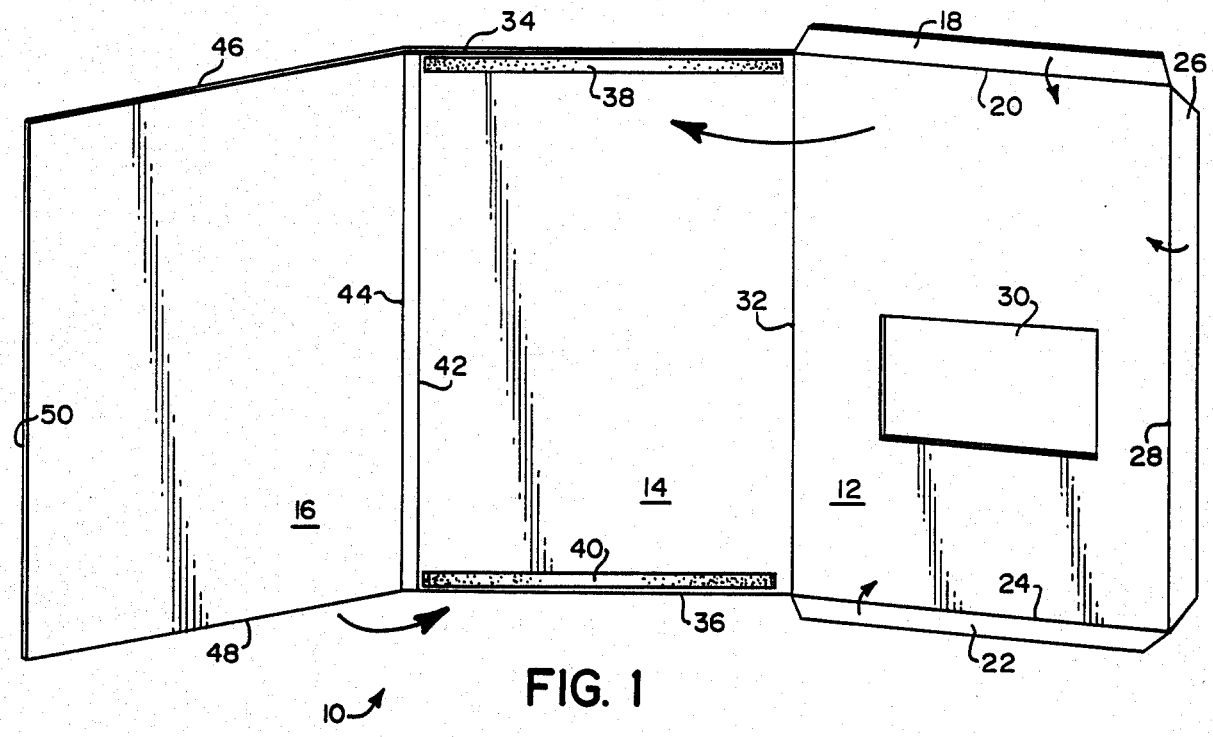
FIG. 1 is a perspective view of a greeting card blank in accordance with an exemplary embodiment of the invention.

Referring now to FIGS. 1 through 4, a greeting card blank 10 is shown to include an elongated sheet divided vertically into three panels 12, 14 and 16. Panel 12 is provided with a top flap or tab 18, foldable about an upper horizontal fold line 20; a bottom flap or tab 22 foldable about a lower horizontal line 24; and a side flap or tab 26 foldable about a vertical fold line 28 extending between the upper and lower fold lines 20, 24, respectively.

A substantially rectangular aperture 30 is cut in the panel 12 and serves as a window through which a portion of the cassette is visible, as further described herein.

A vertical fold line 32 laterally spaced from, and substantially parallel to fold line 28, separates the panel 12 from the middle panel 14. The middle panel is further defined by upper and lower horizontal edges 34, 36 which are in horizontal alignment with the fold lines 20, 24 respectively, of the panel 12.

Panel 14 is further provided with adhesive strips 38,40 which extend horizontally adjacent the upper and lower edges 34, 36 respectively. The purpose the adhesive strips or lines 38, 40 will be explained in detail below.

The third panel 16 is separated from middle panel 14 by double vertical fold lines 42, 44 which are laterally spaced from one another by about 0.25 inches, and which are also substantially parallel to fold lines 28 and 32. Panel 16 is further defined by upper and lower horizontal edges 46, 48 (which are aligned, respectively, with upper and lower edges 34, 36 of the middle panel), and a vertical side edge 50.

It will be appreciated that the blank 10 may be formed by a single die-cut operation performed on a single piece blank, with subsequent folding steps to separate the three panels 12, 14 and 16 as described above. The blank itself is preferably formed of a thin cardboard stock, e.g., 3-ply cover stock.

To complete the formation of the greeting card (or other mailer or display device), the top and bottom flaps 18, 22 are folded inwardly, about respective fold lines 20, 24, so as to prtially overlie the panel 12. The entire panel 12 is subsequently folded about fold line 32 to overlie panel 14, and flaps or tabs 18, 22 are fastened to the panel 14 along adhesive lines 38, 40 which may comprise any suitable adhesive or glue.

Figure 2:
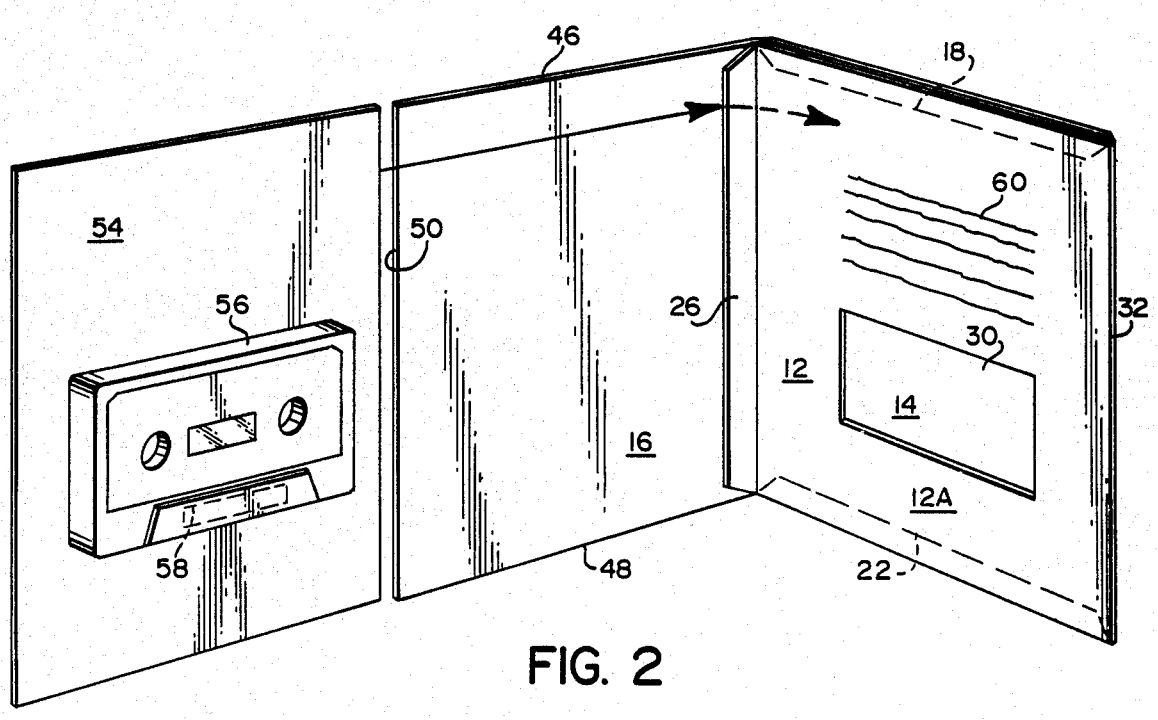
FIG. 2 is a perspective view of a greeting card in accordance with the invention, and further illustrating an associated audio cassette prior to insertion within a pocket formed in the card.

In this intermediate configuration, side flap 26 extends beyond fold lines 42, 44 and partially overlaps the panel 16 as best seen in FIG. 2. It will now be appreciated that an audio cassette receiving pocket 52 (see FIG. 4) has been formed between panels 12 and 14, with a vertical opening between the panels extending generally along the side flap 26 and vertical fold lines 42, 44.

With specific reference now to FIG. 2, a substantially rectangular cassette carrier sheet 54, constructed preferably of the same 3-ply cover stock, is provided for carrying a conventional audio cassette 56. The cassette 56 may be removably secured to the carrier 54 by a relatively small strip of two-sided adhesive tape 58. In this regard, any suitable and relatively low track adhesive (or other means) may be utilized to hold, but easily release, the cassette from the carrier. It will further be appreciated that carrier 54 is sized to fit snugly within the pocket 52 formed between panels 12, 14.

The carrier 54, with cassette 56 affixed thereto, is slid into the pocket 52 and side flap or tab 26 is then folded into the pocket 52 under, or behind, the carrier sheet 54 to firmly secure the cassette and carrier within the pocket 52. Panel 16 which comprises the front cover of the greeting card, is then folded over the combined assembly of inside panels 12 and 14.

The location of messages, pictorial representations, advertising and the like, on the card can be varied as desired, and typically, surface 12A of panel 12 will contain a message or the like, as illustrated at 60 in FIGS. 2 and 3.

In folding panel 16 over the now firmly adhered panels 12 and 14, it will be appreciated that the double fold line 42, 44 is designed to facilitate such folding by accommodating, at least partially, the thickness of the combined cassette/card assembly. This arrangement permits panel 16 to lie in a substantially flat overlying relationship relative to panels 12, 14, as best seen in FIGURE 4.

On the other hand, the double fold line 42, 44 does not so increase the thickness of the card at the fold as to prevent its insertion within a standard envelope. In other words, the relatively sharp fold along vertical fold line 32, and the relatively blunt fold along lines 42, 44 allow the greeting card of this invention to be mailed in standard, flat envelope, which may be of the typical 6x9 inch size.

It will be further appreciated, particularly from FIG. 3, that aperture 30 is sized to permit viewing of only a portion of the cassette 56, thereby providing a sleek, uncluttered appearance, as well as providing additional security against accidental or other removal of the cassette from the card prior to sale and/or mailing.

In carrying out the method aspects of the present invention, relating to the manner in which an audio cassette may be incorporated into a greeting card, display device or similar structure, the following steps are exemplary:

(a) providing an elongated sheet of foldable material 10;

(b) forming a substantially rectangular aperture 30 in the sheet;

(c) folding the sheet to form three panels 12, 14, 16 of substantially identical width;

(d) providing upper and lower tabs or flaps 18, 22, and one side tab or flap 26 on a first of the three panels, e.g., panel 12;

(e) folding the upper and lower tabs 18, 22 inwardly about fold lines 20, 24, respectively, to partially overlie the panel 12;

(f) folding panel 12 about fold line 32 to overlie a second or middle panel 14;

(g) adhesively securing the upper and lower tabs 18, 22 to the second panel 14 to thereby form a pocket 52;

(h) releasably attaching a standard audio cassette 56 to a carrier sheet 54, of a shape and size adapted to fit snugly within the pocket 52;

(i) inserting the audio cassette 56 and carrier 54 into the pocket 52;

(j) folding the side tab or flap 26 about fold line 28 into the pocket 52, behind the carrier 54; and (k) folding the third panel 16 about the double fold lines 42, 44 into overlying relationship with the first and second panels 12 and 14.

Accordingly, the present invention, in its preferred form, provides a greeting card of sturdy, yet simple construction, which is uncluttered in appearance, but which effectively holds the cassette within the card, and which can be mailed in a standard, flat envelope.

It is to be understood that the invention is not limited to greeting card structures per se, but is equally applicable to audio cassette display devices and the like, as well as to greeting cards which incorporate other articles generally similar to audio cassettes. Stated otherwise, while the invention has been described in connection with what is presently considered to be the most practical and preferred embodiment, it is to be understood that the invention is not to be limited to the disclosed embodiment, but on the contrary, is intended to cover various modifications and equivalent arrangements included within the sprit and scope of the appended claims.

We claim:

1. A combination audio cassette and greeting card which comprises:

a single, elongated member folded to provide adjacent first, second and third panels, wherein said first and second panels are adhesively secured to form a pocket;

an audio cassette carrier including means for removably securing a standard audio cassette thereto, said carrier adapted to be slidably received within said pocket, and wherein said first panel includes flap means adapted for folding into the pocket behind the audio cassette.

2. The combination as defined in claim 1 wherein said first panel is an end panel provided with a top flap and a bottom flap, said flap means comprising a side flap extending from an end of the first panel remote from the second panel.

3. The combination as defined in claim 2 wherein said top and bottom flaps partially overlie the first panel and are adhesively secured to the second panel.

4. The combination as defined in claim 3 wherein said first and second panels are defined by a single vertical fold line, and second and third panels are separated by a pair of adjacent, vertical fold lines so that, when an audio cassette is received in said pocket, the third panel may overlie said first and second panels in substantially flat relationship.

5. The combination as defined in claim 4, and wherein said first panel is provided with an aperture for viewing at least a portion of said audio cassette.

6. The combination as defined in claim 1 wherein said first and second panels are separated by a single, vertical fold line.

7. The combination as defined in claim 6

8. The combinatin as defined in claim 1 and wherein said first panel is provided with an aperture for viewing at least a portion of said audio cassette.

9. A greeting card comprising:

first and second inside panels folded into overlying relationship to form a pocket therebetween, said first and second panels separated by a single vertical fold line;

a third cover panel integrally formed with said second panel, said third cover panel separated from said second panel by a vertically oriented, double fold line, such that said cover and said first and second inside panels may overlie each other in a substantially flat relationship; and an audio cassette releasably attached to an audio cassette carrier slidably received within said pocket.

10. A greeting card as defined in claim 9 wherein said first panel includes a side flap foldable into said pocket and behind said carrier to prevent said carrier and said audio cassette from sliding out of said pocket.

11. A greeting card as defined in claim 10 wherein said first panel is provided with a substantially rectangular window for observing at least a portion of said audio cassette when said card is opened.

12. A greeting card as defined in claim 10 wherein said first panel further includes a top flap and a bottom flap folded inwardly to partially overlie said first panel, and wherein said top and bottom flaps are adhesively secured to said second panel.

13. A greeting card as defined in claim 9 wherein said pair of vertical parallel fold lines are laterally spaced from each other by a distance of about 0.25 inches.

14. A greeting card as defined in claim 9 wherein said front cover, inside panels and audio cassette carrier card are constructed of 3-ply cardboard cover stock.

15. A method of enclosing an audio cassette within a greeting card comprising the steps of:

(a) providing an elongated sheet of foldable material;

(b) folding said sheet to form three panels of substantially identical width;

(c) providing upper, lower and at least one side tabs on a first of said three panels;

(d) folding said upper and lower tabs inwardly to partially overlie first panel;

16. The method of claim 15 wherein, prior to step (d), an aperture is formed in said first of said three panels.

17. The method of claim 15 wherein step (a) is practiced by providing a sheet of 3-ply cover stock.

18. A greeting card comprising:

first and second inside panels folded into overlying relationship to form a pocket therebetween;

a third cover panel integrally formed with one of said first and second panels, said third cover panel separated from said one of said first and second panels by a vertically oriented, double fold line, such that said cover and said first and second inside panels may overlie each other in a substantially flat relationship; and an audio cassette releasably attached to an audio cassette carrier slidably received within said pocket, wherein said first panel includes a side flap foldable into said pocket and behind said carrier to prevent said carrier and said audio cassette from sliding out of said pocket.

19. A greeting card as defined in claim 18 wherein said first panel is provided with a substantially rectangular window for observing at least a portion of said audio cassette when said card is opened.

20. A greeting card as defined in claim 18 wherein said first panel further includes a top flap and a bottom flap folded inwardly to partially overlie said first panel, and wherein said top and bottom flaps are adhesively secured to said second panel.

* * * * *